US005520198A

United States Patent [19]

Lin

[11] Patent Number: 5,520,198

[45] Date of Patent: May 28, 1996

[54] HEAD MOUNT TYPE CIGARRETTE HOLDER

[76] Inventor: Yuan Y. Lin, No. 237, Kuo An Street, Tainan City, Taiwan

[21] Appl. No.: 411,447

[22] Filed: Mar. 28, 1995

[51] Int. Cl.[6] ..... A24F 13/02

[52] U.S. Cl. ..... 131/330; 131/175; 131/206; 131/202; 131/187

[58] Field of Search ..... 381/169, 379, 381/183, 187; 131/329, 330, 175, 187, 178; D14/205; 128/207.17

[56] References Cited

U.S. PATENT DOCUMENTS 2,911,982 11/1959 Guden ..... 131/175
5,185,807 2/1993 Bergin et al. ..... 381/183
5,368,024 11/1994 Jones ..... 128/207.17
5,381,486 1/1995 Ludeke et al. ..... 381/187

*Primary Examiner*—V. Millin
*Assistant Examiner*—Charles W. Anderson
*Attorney, Agent, or Firm*—Pro-Techtor International

[57] ABSTRACT

A head mount type cigarette holder including a headpiece having two locating plates at two opposite ends, a coupling device pivotably fastened to one locating plate to hold a tube, a holder base connected to the tube by an adapter to hold a cigarette carrier for carrying a piece of cigarette for smoking.

3 Claims, 6 Drawing Sheets

HEAD MOUNT TYPE CIGARRETTE HOLDER

BACKGROUND OF THE INVENTION

The present invention relates to cigarette holders, and relates more particularly to a head mount type cigarette holder which can be fastened to the head to hold a burning piece of cigarette for smoking.

Smoking is a joyful thing to those heavy smokers. However, it is not convenient to hold a burning piece of cigarette with the fingers for smoking when one is working or drives a car. Furthermore, frequently holding a burning piece of cigarette in the fingers will cause the skin of the fingers blackened.

SUMMARY OF THE INVENTION

The present invention has been accomplished under the circumstances in view. It is one object of the present invention to provide a head mount type cigarette holder which can be fastened to the head to hold a burning piece of cigarette for smoking. It is another object of the present invention to provide a head mount type cigarette holder which automatically collects cigarette ashes while smoking.

According to one aspect of the present invention, the head mount type cigarette holder is comprised of a headpiece having two locating plates at two opposite ends, a coupling device pivotably fastened to one locating plate to hold a tube, a holder base connected to the tube by an adapter to hold a cigarette carrier.

According to another aspect of the present invention, the cigarette carrier has an upright stop plate at the front end for stopping cigarette ashes so that cigarette ashes can be accumulated in the cigarette carrier.

According to still another aspect of the present invention, the positions of the locating plates can be exchanged so that the coupling device can be fastened to the headpiece at the left side or the right side as desired.

According to still another aspect of the present invention, the locating plates have a respective pair of lugs at the top pivotably connected to one end of the base frame of the headpiece.

DETAILED DESCRIPTION OF THE PREFERRED EMBODIMENT

Figure 1:
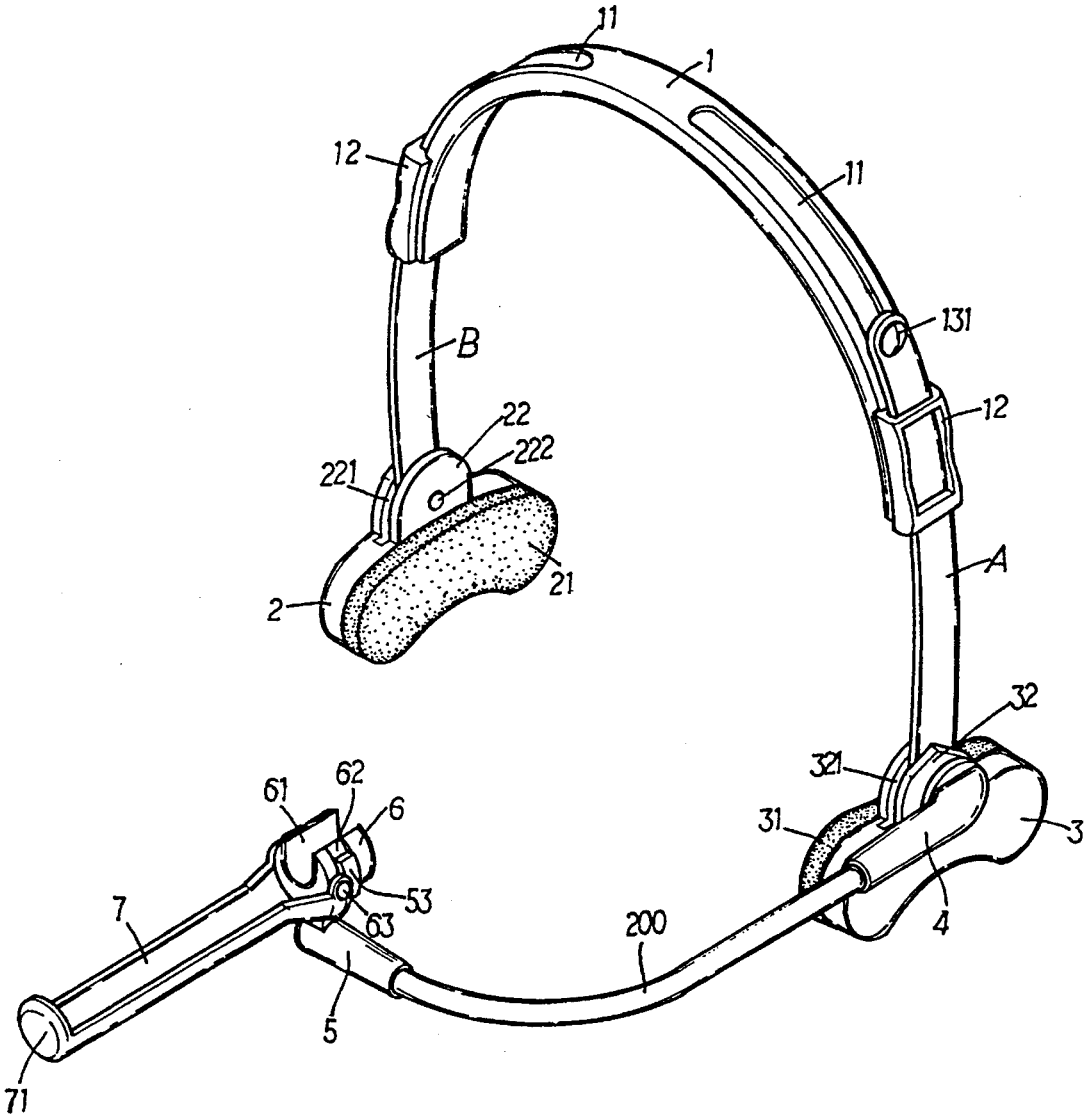
FIG. 1 is an elevational view of a head mount type cigarette holder according to the present invention.
Figure 3:
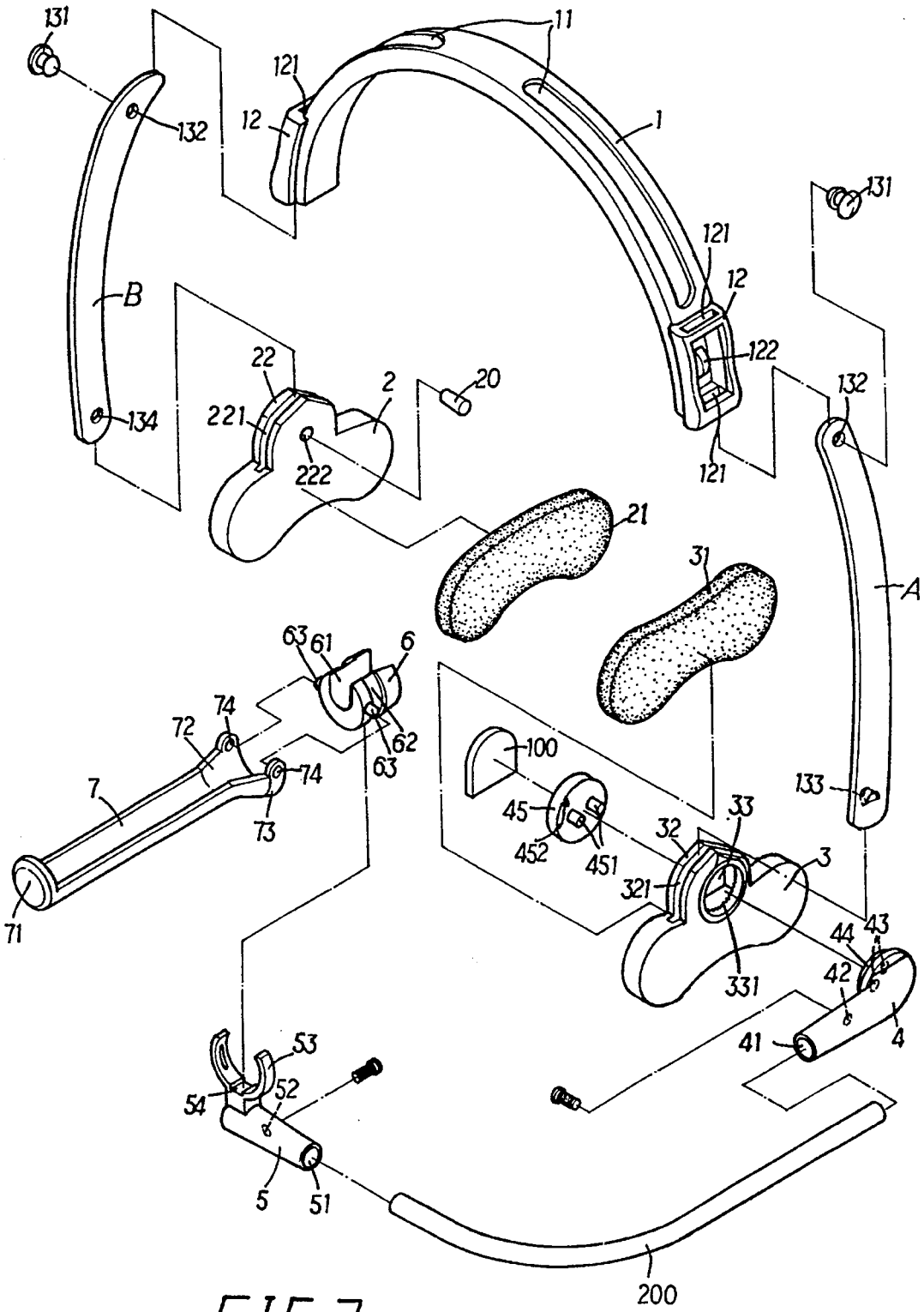
FIG. 3 is an exploded view of the head mount type cigarette holder shown in FIG. 1.
Figure 4:
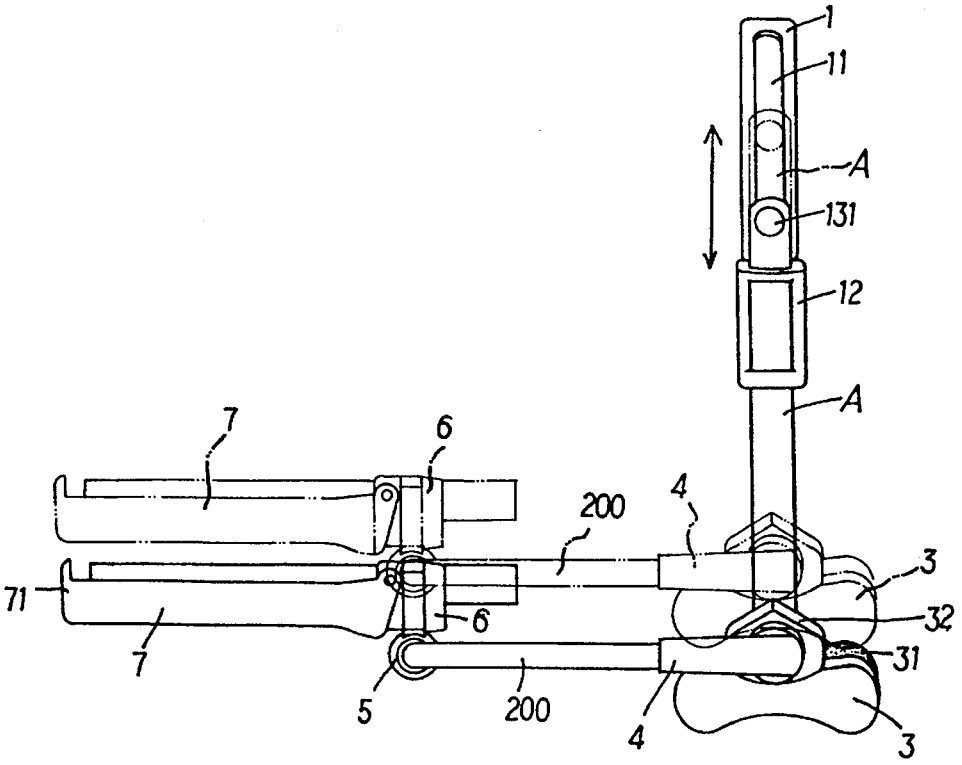
FIG. 4 is a schematic drawing showing the combined length of the headpiece adjusted according to the present invention.

Referring to FIGS. 1 and 3, a cigarette holder in accordance with the present invention is generally comprised of a headpiece consisting of a base frame 1, two extension strips A and B and two locating plates, namely, the first locating plate 2 and the second locating plate 3, a coupling device 4, an adapter 5, a tube 200, a holder base 6, and a cigarette carrier 7.

The base frame 1 is made of arched shape, comprising two elongated sliding slots 11, and two hollow coupling blocks 12 at two opposite ends, each coupling block 12 having two through holes 121 at two opposite ends and a stop rod 122 in the middle. The extension strips A and B are respectively inserted through the through holes 121 on each coupling block 12, having a respective front end made with a round hole 132 connected to one sliding slot 11 by a bolt 131 and a respective rear end made with a through hole 134 or retaining rod 133. The bolt 131 can be moved along the respective sliding slot 11, therefore the extension strips A and B can be moved relative to the base frame 1 to adjust the combined length of the headpiece.

The first locating plate 2 is fixed with a cushion 21 at an inner side, having a pair of lugs 22 at the top separated by a space 221 and a pivot hole 222 through the pair of lugs 22. The rear end of the extension strip B is inserted into the space 221 and pivotably connected to the pivot hole 222 between the pair of lugs 22 by a pivot 20.

The second locating plate 3 is fixed with a cushion 31 at an inner side, having a pair of lugs 32 at the top separated by a space 321, a mounting hole 33 through the pair of lugs 32, and a toothed portion 331 on one lug 32 (the outer one) around the mounting hole 33 adjacent to the space 321.

Figure 5:
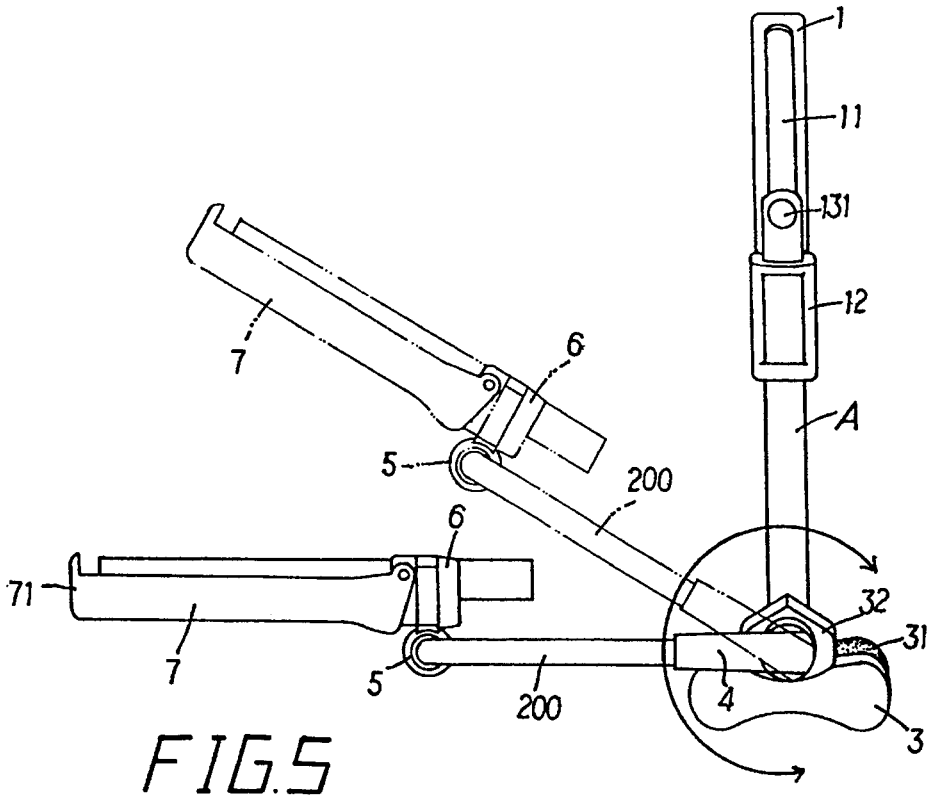
FIG. 5 is a schematic drawing showing the angular position of the coupling device adjusted relative to the headpiece according to the present invention.
Figure 6:
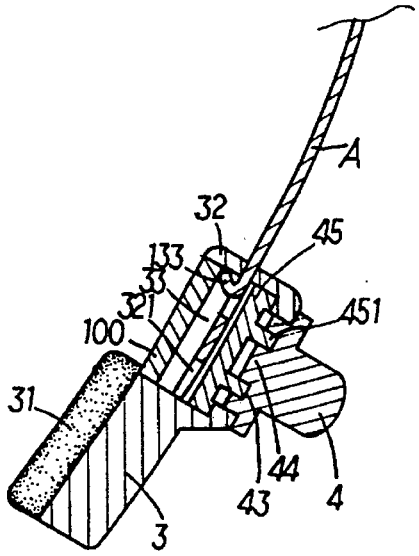
FIG. 6 is a sectional assembly view of the extension strip A, the second locating plate, and the coupling device according to the present invention.
Figure 9:
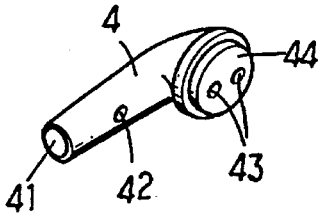
FIG. 9 is an elevational view of the coupling device according to the present invention.

The coupling device 4 (see also FIG. 9) comprises a longitudinal hole 41 at one end, a radial screw hole 42 perpendicularly communicated with the longitudinal hole 41, a plug portion 44 with pin holes 43 at an opposite end. The plug portion 44 of the coupling device 4 is inserted into the mounting hole 33 and then connected to the one (outer) lug 32 by a fastening plate 45. The fastening plate 45 has a toothed portion 452 meshed with the toothed portion 331, and a plurality of upright pins 451 respectively fitted into the pin holes 43 on the plug portion 44 of the coupling device 4. When installed, the coupling device 4 can be turned in the mounting hole 33 to adjust the angular position of the longitudinal hole 41 relative to the second locating plate 3 (see FIG. 5). After the installation of the coupling device 4, the rear end of the extension strip A is inserted into the space 321, permitting the retaining rod 133 to be hooked in the mounting chamber 33 (see FIG. 6), and then a cap 100 is fastened to the mounting hole 33 to hold down the extension strip A. When the cap 100 is installed, the extension strip A can be turned within the space 321 relative to the second locating plate 3.

The adapter 5 comprises a longitudinal hole 51 at one end, a radial screw hole 52 perpendicularly communicated with the longitudinal hole 51, a substantially U-shaped clamp 53 at an opposite end. The U-shaped clamp 53 has a transverse groove 54 on the inside in the middle, which enables the the U-shaped clamp 53 to be stretched outwards flexibly.

The tube 200 has one end fitted into the longitudinal hole 41 on the coupling device 4 and then fixed in place by threading a tightening up screw into the radial screw hole 42 on the coupling device 4, and an opposite end fitted into the longitudinal hole 51 on the adapter 5 and then fixed in place by threading a tightening up screw into the radial screw hole 52 on the coupling device 4. The tube 200 is preferably made of resilient material so that it can be bent into a desired shape or curved to the desired direction.

The holder base 6 comprises a cigarette holding chamber 61 at the top, a mounting groove 62 around the bottom side clamped by the U-shaped clamp 53 of the adapter 5, and two pins 63 at two opposite lateral sides.

The cigarette carrier 7 is made of elongated shape for carrying a piece of cigarette, having an upright stop plate 71 at one end and a bearing portion 72 at an opposite end for holding a part of the holder base 6. The bearing portion 72 is made broader toward the outer end, having a stop edge 73 and two pivot holes 74 bilaterally disposed at the top. By fitting the pins 63 into the pivot holes 74, the holder base 6 is pivotably fastened to the bearing portion 72 of the cigarette carrier 7.

Figure 7:
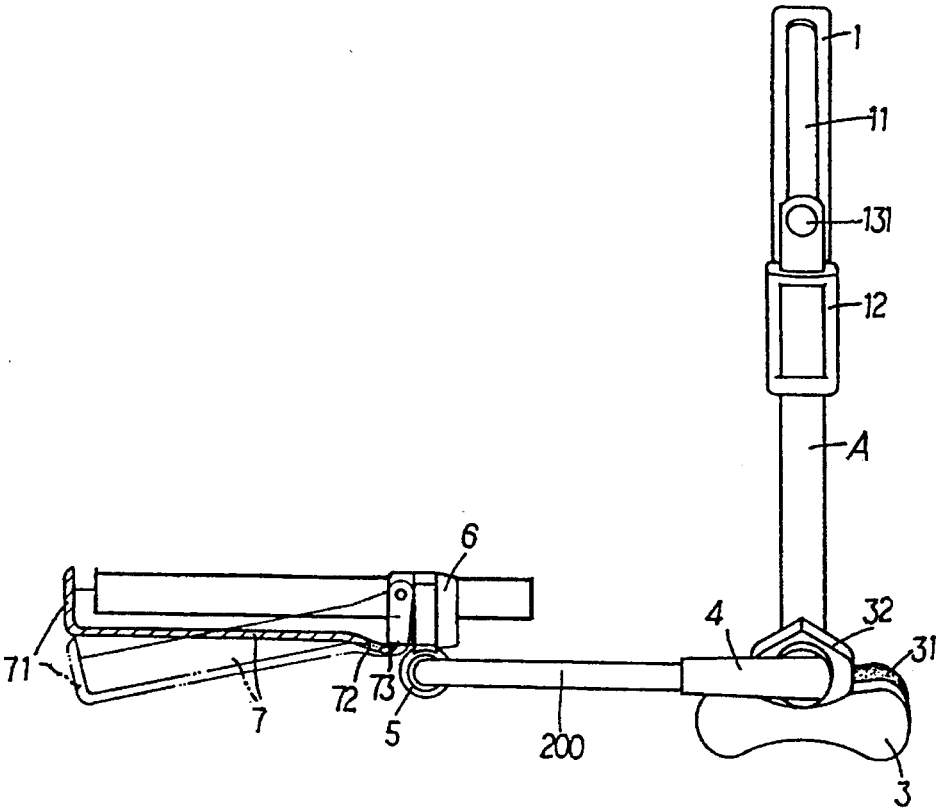
FIG. 7 is a schematic drawing showing the cigarette carrier turned downwards from the piece of cigarette according to the present invention.
Figure 8:
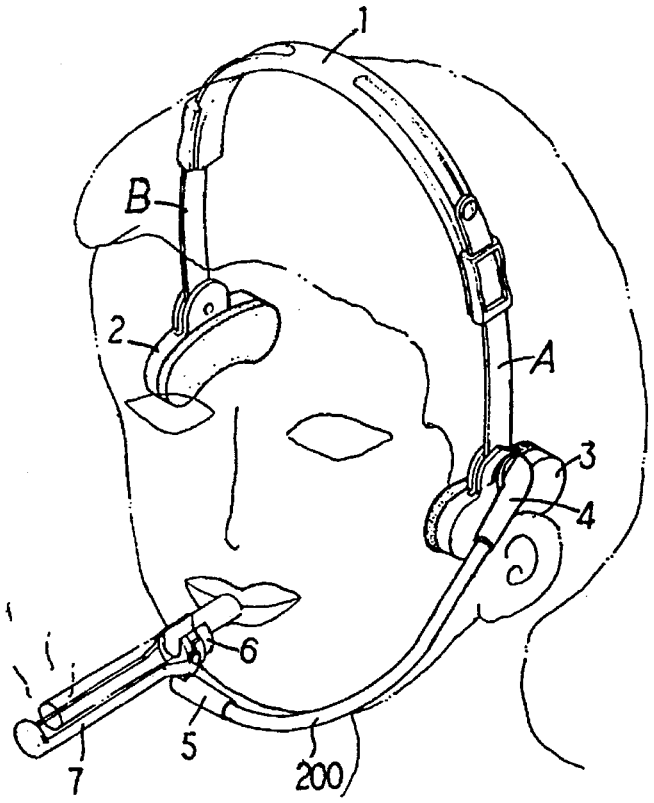
FIG. 8 is an applied view showing the cigarette holder fastened to the user's head and a burning cigarette carried on the holder base and the cigarette carrier according to the present invention.

When in use, the headpiece is fastened to the head, then the piece of cigarette is inserted into the cigarette holding chamber 61 and the cigarette carrier 7 and then the cigarette carrier 7 is turned downwards from the piece of cigarette for letting the piece of cigarette to be lighted up (see FIG. 7), and then the cigarette carrier 7 is turned upwards to let the stop edge 73 be stopped against the front end of the holder base 6, and then the tube 200 is turned inwards to move the holder base 6 toward the mouth so that the user can breathe the smoke of the piece of cigarette in and out (see FIG. 8). The ashes of the burning piece of cigarette is accumulated in the cigarette carrier 7 and stopped at the stop plate 71.

Figure 2:
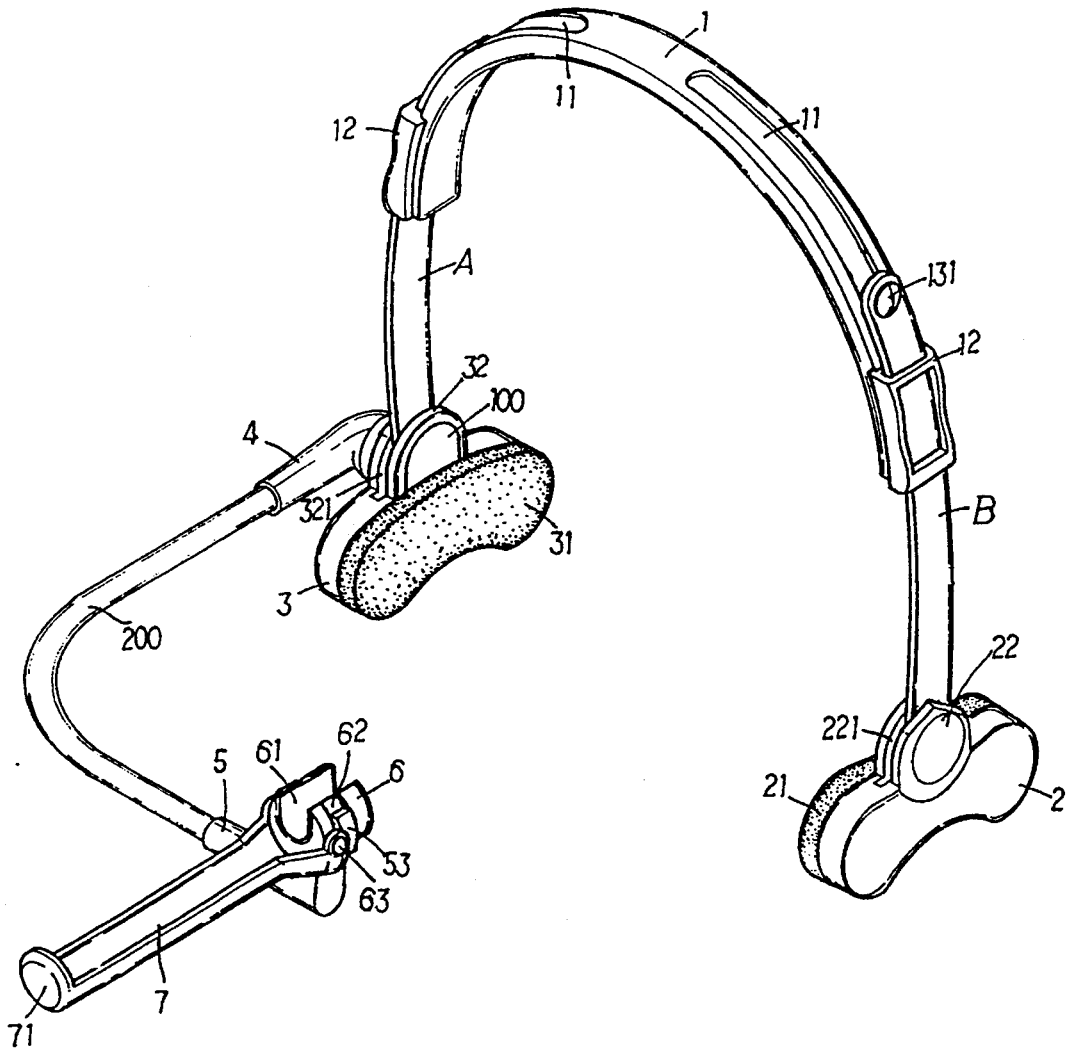
FIG. 2 is similar to FIG. 1 but showing the positions of the extension strips and the locating plates relatively changed.

Referring to FIG. 2, and FIG. 1 again, the positions of the extension strips A and B and the locating plates 2 and 3 may be respectively changed so that the tube 220 can be disposed at the user's left side (see FIG. 1) or right side (See FIG. 2).

It is to be understood that the drawings are designed for purposes of illustration only, and are not intended as a definition of the limits and scope of the invention disclosed.

What is claimed is:

1. A cigarette holder comprising:

a headpiece consisting of a narrow, elongated base frame having two hollow coupling blocks at two opposite ends, two extension strips having a respective top end respectively inserted through said coupling blocks and connected to said base frame by a respective slip joint and a respective bottom end coupled with a respective locating plate, the locating plates on said extension strips including a first locating plate and a second locating plate, said first locating plate having a mounting hole and a toothed portion around said mounting hole;

a coupling device coupled to the mounting hole on said first locating plate by a fastening plate to hold a tube, said coupling device comprising a longitudinal hole at one end, which receives one end of said tube, a radial screw hole, a tightening up screw threaded into the radial screw hole to hold down said tube, a plug portion inserted into the mounting hole on said first locating plate and having a plurality of pin holes, said fastening plate being inserted into the mounting hole on said first locating plate and having a toothed portion meshed with the toothed portion on said first locating plate and a plurality of upright pins respectively fitted into the pin holes on the plug portion of said coupling device;

an adapter having one end connected to said tube at an opposite end relative to said coupling device and an opposite end made with a U-shaped clamp;

a holder base fastened to the U-shaped clamp of said adapter, said holder base comprising a cigarette holding chamber at a top side thereof for holding a piece of cigarette, a mounting groove around a bottom side thereof clamped by the U-shaped clamp of said adapter, and two pins at two opposite lateral sides thereof; and an elongated cigarette carrier pivotably connected to said holder base for carrying said piece of cigarette, said cigarette carrier having two pin holes bilaterally disposed at one end and respectively pivotably fastened to the pins on said holder base.

2. The cigarette holder of claim 1 wherein said tube is made of resilient material that can be bent to the desired shape.

3. The cigarette holder of claim 1 wherein each locating plate has two top lugs separated by a space and pivoted to one extension strip at an opposite end remote from the respective slip joint.

* * * * *